United States Patent [19]

Jungesjo

[11] 4,383,428

[45] May 17, 1983

[54] LOADER FOR THIN-WALL SPLINE ROLLING MACHINE

[75] Inventor: Harald N. Jungesjo, Rochester, Mich.

[73] Assignee: Anderson-Cook, Inc., Fraser, Mich.

[21] Appl. No.: 237,022

[22] Filed: Feb. 23, 1981

[51] Int. Cl.[3] ..... B21D 9/14; B21D 17/00; B21D 53/28

[52] U.S. Cl. ..... 72/88; 72/125; 72/422; 72/420; 279/1 G

[58] Field of Search ..... 72/88-90, 72/420, 422, 469, 125; 279/1 G; 29/159.2

[56] References Cited

U.S. PATENT DOCUMENTS

| | | | |
|---|---|---|---|
| 2,803,159 | 8/1957 | Hohwart et al. | 279/1 G |
| 3,036,838 | 5/1962 | Barber | 279/1 G |
| 3,631,704 | 1/1972 | Leonard et al. | 29/159.2 |
| 3,982,415 | 9/1976 | Killop | 72/88 |
| 4,028,922 | 6/1977 | Killop | 72/88 |
| 4,083,215 | 4/1978 | Guetzlaff | 72/125 |
| 4,155,237 | 5/1979 | Junqesjo | 72/88 |

*Primary Examiner*—Daniel C. Crane
*Attorney, Agent, or Firm*—Reising, Ethington, Barnard, Perry, Brooks & Milton

[57] ABSTRACT

A loader (12) for a spline rolling machine wherein die and mandrel teeth (26,42) mesh with the thinwall sleeve (44) of a power transmission member (30) located therebetween to form splines therein is disclosed as including a loading member (58) with a locator (68) on a rotatable clamp (66) thereof and as including an unloading member (60) having a depression (72) that receives the locator (68) so as to permit clamping of an end wall (46) of the power transmission member (30) in an accurately located relationship while still ensuring disengagement during unloading upon movement of the loading and unloading members (58,60) away from each other at an associated load table (36). The locator (68) preferably has a detachable connection (88) to a housing (78) of the rotatable clamp (66) on the loading member (58), and the unloading member (60) includes a shaft (98) and an enlarged head (100) secured to the shaft by a detachable connection (102,104) in order to facilitate loading and unloading of different size power transmission members by merely replacing the locator and the enlarged head. Clamping surfaces (70,74) on the loading member clamp housing (78) and the enlarged head (100) of the unloading member clamp the power transmission member (30) during the loading and unloading.

8 Claims, 2 Drawing Figures

LOADER FOR THIN-WALL SPLINE ROLLING MACHINE

TECHNICAL FIELD

This invention relates to a loader for a machine having apparatus for splining an annular thin-wall sleeve of a power transmission member.

BACKGROUND ART

U.S. Pat. No. 3,982,415, which is assigned to the assignee of the present invention, discloses a machine having apparatus for splining an annular thin-wall sleeve of a power transmission member by meshing die and mandrel teeth with the sleeve located therebetween such that the resultant forming thereof provides the splines. This spline forming process takes place in a rolling manner as a mandrel on which the power transmission member is mounted rotates upon movement of toothed dies in opposite directions on opposite sides of the mandrel to provide the tooth meshing. An end wall of the power transmission member is clamped against an end of the mandrel during the splining process so as to ensure precise forming of the resultant splines. Clutch hubs for automatic transmissions of road vehicles is one usage for which this spline forming process has particular utility in replacing prior impacting operations used to form clutch hub splines as discussed in the aforementioned patent.

U.S. Pat. No. 4,155,237, which is also assigned to the assignee of the present invention, discloses apparatus for automatically loading and unloading power transmission members on a toothed mandrel for splining of thin-wall sleeves thereof by meshing of die and mandrel teeth in the manner discussed above. Loading and unloading members driven by associated hydraulic cylinders are provided to cooperatively clamp and move power transmission members to be splined from a load table toward and away from the mandrel. Both cylinders are hydraulically driven during loading movement toward the mandrel and during unloading movement away from the mandrel back toward the load table. After movement of the splined power transmission member back to the load table, the loading and unloading members are moved away from each other to permit indexing of the load table for alignment of another member to be splined with the loading and unloading members, and it is thus important that the previously splined member be disengaged from both the loading and unloading members at the load table prior to this indexing so as to permit the subsequent loading of the next power transmission member.

DISCLOSURE OF INVENTION

An object of the present invention is to provide an improved loader for loading and unloading power transmission members of the type having a thin-wall sleeve and an end wall with an opening on a toothed mandrel for splining of the sleeve as a pair of toothed dies are moved in opposite directions with respect to each other on opposite sides of a rotational axis of the mandrel such that the die and mandrel teeth mesh with the sleeve therebetween to form the splines in the sleeve.

In carrying out the above object and other objects of the invention, the loader includes a loading member that is movable along the rotational axis of the mandrel toward and away therefrom and which has a rotatable clamp including a locator that is received within the opening of the end wall of a power transmission member to be splined. The clamp also includes a clamping surface that extends about the locator so as to engage the end wall of the power transmission member. An unloading member of the loader is also movable along the rotational axis of the mandrel toward and away therefrom in coordination with the loading member. A depression of the unloading member receives the locator of the loading member during the coordinated movement of the loading and unloading members and a clamping surface of the unloading member extends about the depression thereof so as to engage the end wall of the power transmission member in an opposed clamping relationship with the clamping surface of the loading member in order to support the power transmission member during loading and subsequent unloading movement onto and from the mandrel.

The locator and depression respectively provided on the loading member and the unloading member ensure disengagement of the loading and unloading members from a splined power transmission member during unloading thereof such as at an associated load table that indexes power transmission members to be splined into alignment with the axis of movement during loading and unloading. After indexing of another power transmission member to be splined into alignment with the axis of movement, the loading and unloading members are moved toward each other to clamp the end wall of the aligned power transmission member and are then moved in a coordinated manner toward the mandrel for mounting thereon to perform the splining of the thin-wall sleeve as the clamping surface of the loading member cooperates with an end of the mandrel to secure the end wall of the power transmission member. Coordinated movement of the loading and unloading members away from the mandrel after the splining to the load table is thereafter performed in preparation for the next cycle. Movement of the loading and unloading members away from each other and out of engagement with the previously splined power transmission member permits the indexing of the load table such that the next member to be splined is moved into alignment with the axes of loading and unloading member movement.

A detachable connection is preferably provided for securing the locator to the rotatable clamp of the loading member. Attachment of different size locators is thereby permitted so that power transmission members with different size end wall openings can be loaded and unloaded by merely securing an appropriately sized locator to the clamp. Also, the loading member clamp includes a housing defining the clamping surface thereof, and the loading member also includes a shaft on which the clamp housing is rotatably mounted by anti-friction bearings.

The unloading member of the loader preferably includes a shaft and an enlarged head on which the depression and clamping surface of the unloading member are provided, and the unloading member also includes a detachable connection for securing the enlarged head to the shaft. Thus, attachment of different heads to the shaft as permitted by its detachable connection permits the unloading member to receive different size locators on the loading member in order to further facilitate the splining of power transmission members having different size end wall openings.

In order to provide loading and unloading of power transmission members having annular end walls, the locator of the loading member clamp includes a locating surface of an annular shape whose diameter is just slightly smaller than the end wall opening of a power transmission member to be loaded and unloaded. The depression of the unloading member has a round shape whose diameter is just slightly larger than the diameter of the annular locating surface on the locator so as to receive the locator during the coordinated movement of the loading and unloading members. The clamping surfaces on the housing of the loading member clamp and on the enlarged head of the unloading member also have annular shapes for clamping the annular end wall of the power transmission member during loading and unloading. The annular clamping surface on the clamp housing of the loading member has an outer diameter that is larger than the outer diameter on the annular clamping surface on the enlarged head of the unloading member so as to permit clamping of the end wall of the power transmission member against the end of the mandrel as the spline forming takes place. An opening through the mandrel along the axis of rotation thereof has an enlarged end adjacent the mandrel end against which the end wall of a power transmission member being splined is clamped. The shaft of the unloading member extends through the mandrel opening and the enlarged head thereof is received within the enlarged end of the opening during the splining operation to permit the clamping of the end wall of the power transmission member by the rotatable clamp and the end of the mandrel.

A pair of hydraulic cylinders are connected to the loading and unloading members to provide coordinated movement thereof during the loading and unloading operations. The hydraulic cylinder connected to the loading member provides the impetus for the movement during the loading as the power transmission member to be splined is loaded on the mandrel and as the enlarged head of the unloading member moves into the enlarged end of the opening through the mandrel. The hydraulic cylinder connected to the unloading member provides the impetus for movement as the splined power transmission member is removed from the mandrel by movement of the enlarged head of the unloading member out of the enlarged end of the mandrel opening.

The above object and other objects, features and advantages of the present invention are readily apparent from the following detailed description of the bese mode for carrying out the invention when taken in connection with the accompanying drawings.

BEST MODE FOR CARRYING OUT THE INVENTION

Figure 1:
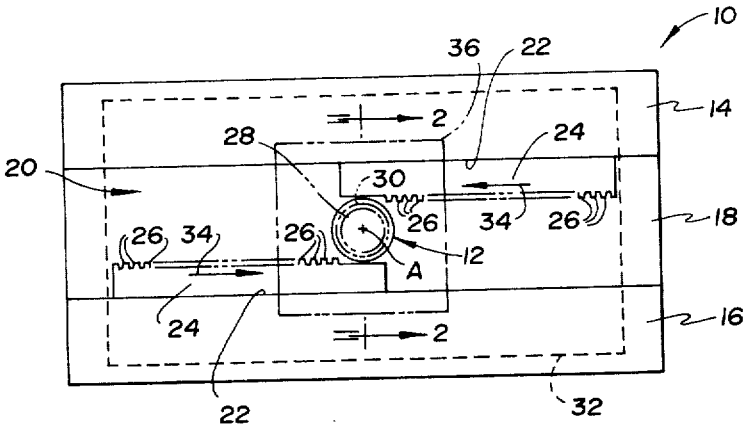
FIG. 1 is a front elevation view of a spline rolling machine including a schematically indicated loader constructed in accordance with the present invention.

Referring to FIG. 1 of the drawings, a spline forming machine indicated generally by 10 incorporates a schematically indicated loader 12 that is constructed in accordance with the present invention. Upper and lower bases 14 and 16 of the machine 10 are interconnected by a vertically extending connecting portion 18 and project forwardly therefrom so as to define a workspace 20 where the spline forming is performed. Conventional slideways 22 on the upper and lower bases 14 and 16 mount upper and lower toothed dies embodied by upper and lower racks 24 with associated forming faces having teeth 26 spaced along the lengths thereof between leading and trailing ends of the racks. An externally toothed mandrel 28 that is rotatably mounted within the workspace 20 about an axis of rotation A receives a schematically indicated annular power transmission member 30 to be splined by a loading operation of the loader 12. A schematically indicated drive mechanism 32, such as of the type disclosed by the U.S. Pat. No. 3,793,866, of Anderson moves the toothed racks 24 in the direction of the arrows 34 from their end-to-end position shown into an overlapping relationship in order to perform the splining. Such movement of the toothed racks 24 in opposite directions to each other and on opposite sides of the axis A of mandrel rotation meshes the die and mandrel teeth with a thin-wall annular sleeve of the power transmission member 30 therebetween in order to form the splines in the sleeve. Drive mechanism 32 subsequently moves the toothed racks 24 in the opposite directions as arrows 34 back to the end-to-end position shown for unloading of the splined member 30 by the loader 12.

Figure 2:
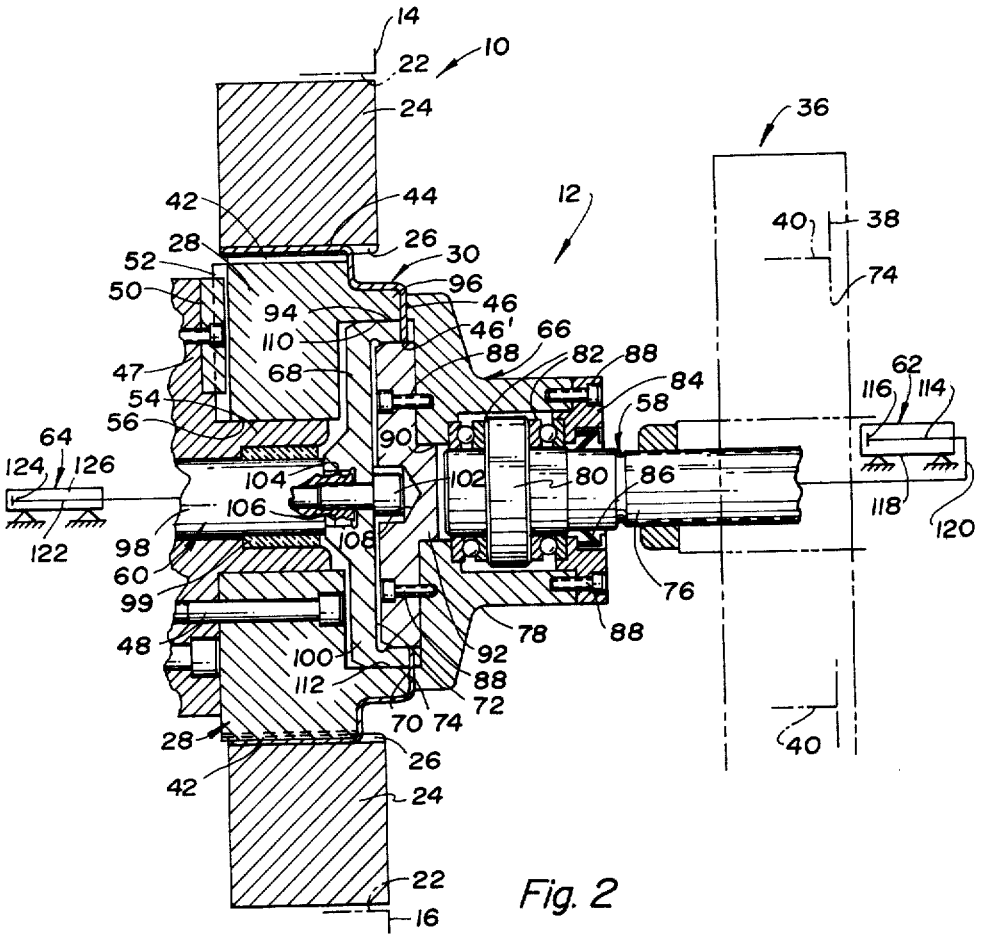
FIG. 2 is a sectional view through the loader and the machine taken generally along line 2—2 of FIG. 1.

Referring to FIG. 2, loader 12 moves each power transmission member 30 to be splined from a load table 36 to the mounted position shown on the mandrel 28 for the splining operation and thereafter moves the splined member back to the load table in preparation for the next cycle. Load table 36 is generally of the type disclosed by U.S. Pat. No. 4,155,237 and includes a schematically illustrated index carriage 38 having sets of workpiece positioners 40 for locating power transmission members received by the carriage. Indexing of carriage 38 moves each set of positioners 40 initially into alignment with an unshown input chute to receive a power transmission member 30 therefrom, thereafter into alignment with the loader 12 along the axis of mandrel rotation for the splining operation, and subsequently into alignment with an output chute to deliver the splined power transmission member. Operation of the loader 12 moves the power transmission member 30 in alignment therewith from the load table 36 onto the mandrel 28 such that meshing of the die teeth and teeth 42 of the mandrel provides the splining of an annular thin-wall sleeve 44 of the power transmission member in the manner previously described. An annular end wall 46 of the power transmission member is clamped by the loader 12 during the movement onto the mandrel 28 for the splining and during movement therefrom after completion of the splining. As previously mentioned, the movement of the loader 12 takes place along the axis of mandrel rotation. Mandrel 28 is supported about its rotational axis by a spindle 47 and is secured thereto by a plurality of bolts 48 as well as by a bolted key 50 received within a radial slot 52 of the mandrel. An annular extension 54 of the spindle 47 is received within a central mandrel opening 56 through which the axis of mandrel rotation extends and along which the loader 12 moves during both the loading and unloading operations.

As seen in FIG. 2, loader 12 includes a loading member 58 and an unloading member 60 which are respectively moved along the axis of mandrel rotation by associated hydraulic cylinders 62 and 64. Loading member 58 has a rotatable clamp 66 including a locator 68 received within the opening 46' through the end wall of a power transmission member 30 being loaded or unloaded. An annular clamping surface 70 of the clamp 66 extends about the locator 68 thereof and engages the end wall 46 of the power transmission member 30 being loaded or unloaded. Unloading member 60 is moved in coordination with the loading member and includes a depression 72 that receives the locator 68 of the loading member during the loading and unloading operations. An annular clamping surface 74 of the unloading member extends about the depression 72 thereof and engages the end wall 46 of the power transmission member during both the loading and unloading operations in order to cooperate with the clamping surface 70 of the loading member in a clamping relationship that secures the power transmission member during movement between the load table 36 and the mandrel 28.

Prior to each splining operation, the hydraulic cylinders 62 and 64 respectively position the loading and unloading members 58 and 60 on opposite sides of the load table 36 such that the carriage 38 can be indexed to move a previously splined member 30 out of alignment therewith and at the same time move the next power transmission member to be splined into alignment with the axis of mandrel rotation. Suitable hydraulic circuitry then operates the hydraulic cylinders 62 and 64 to move the loading and unloading members 58 and 60 toward each other into a clamping relationship with the aligned power transmission member. Hydraulic fluid supplied to the cylinder 62 then provides a driving impetus for moving the loading member 58 toward the left to move the power transmission member 30 from the positioners 40 on the carriage 38 toward the mandrel 28. Hydraulic fluid is permitted to exhaust from the unloading member cylinder 64 at a controlled rate in order to maintain the clamping relationship of the power transmission member during such loading movement while the loading member cylinder 62 provides the impetus for the loading movement. After the splining operation, hydraulic fluid supplied to the unloading member cylinder 64 moves the unloading member 60 toward the right to unload the splined power transmission member 30 from the mandrel and provide movement thereof to the carriage 38 of the load table. Upon reaching the carriage 38, the loading member 58 is driven by its associated hydraulic cylinder 62 further toward the right and the unloading member 60 is concomitantly moved in an opposite direction toward the left such that the splined member 30 is received between the carriage positioners 40 in preparation for the indexing that commences the next cycle. The right end of the splined power transmission member 30 engages the table carriage 38 about an opening 74 thereof as the unloading member 58 moves toward the right. Even if the splined power transmission member 30 has a snug fit between its end wall opening 46' and the locator 68 due to tolerance variations, the construction of the loader with the locator on the loading member ensures complete unloading thereof while still permitting accurate location of the clamped power transmission member by the locator during the loading operation.

Unloading member 58 includes a shaft 76 whose right end is connected to the associated hydraulic cylinder 62 and whose left end rotatably supports an annular housing 78 of the clamp 66. A flange 80 of shaft 76 is received within the clamp housing 78 and engaged by first races of left and right antifriction thrust bearings whose other races are respectively engaged by the clamp housing 78 and an annular end closure 84 thereof such that bearing elements between the races of each bearing provide an antifriction rotational support for the clamp housing. End closure 84 of the clamp housing 78 has an annular shape including an annular seal 86 that provides a sealed relationship of the shaft 76 with the end closure which is secured to the housing by bolts 88.

The locator 68 of the rotatable clamp 66 is secured to the housing 78 by a detachable connection that is provided by a plurality of bolts 88. An opening 90 in the left end of the clamp housing 78 receives a central positioner 92 of the locator 68 in order to ensure precise location thereof with respect to the housing. An annular locating surface 94 of the locator 68 is thus precisely located with respect to the axis of mandrel rotation. At its left end, the annular surface 94 has a taper for ensuring insertion of the locator through the end wall opening 46' during the initial step of the loading operation. Clamping surface 70 of the clamp 66 is defined on the left end of the housing 78 thereof and has an annular shape whose inner diameter is larger than the clamping surface 74 on the unloading member to facilitate clamping of the power transmission end wall 46 against a mandrel end 96 by the clamping surface of the loading member clamp. As the splining is performed with the power transmission member so clamped, the antifriction bearings 82 support the clamp housing 78 for rotation with the power transmission member while the clamping surface 74 of the unloading member 60 remains stationary.

Unloading member 60 includes a shaft 98 whose left end is connected to the associated hydraulic cylinder 64 and whose right end is slidably supported by a bushing 99 within the mandrel opening 56 along the axis of mandrel rotation. An enlarged head 100 of the unloading member 60 defines the depression 72 thereof and is secured to the right end of the shaft 98 by a detachable connection provided by a bolt 102. A reduced size extension 104 of shaft 98 is received within an opening 106 of the head 100 so as to cooperate with the bolt 102 in securely locating the enlarged head on the shaft. A hole 108 in the locator 68 of the loading member receives the head of the bolt 102 so as to permit sufficient movement of the loading and unloading members toward each other to the clamping position shown. Depression 72 in the enlarged head 100 has a round shape whose annular surface 110 is just slightly larger than the annular locating surface 94 of the locator 68 so as to permit the inserted relationship of the locator into the depression in the clamping position. An enlarged end 112 of the mandrel opening 56 receives the enlarged head 100 of the unloading member 60 with the splined member 30 clamped thereon by the rotatable clamp 66 and has a round shape that is no larger than the inner diameter of the clamping surface 70 on the rotatable clamp housing 78 of the loading member so as to facilitate the clamping of the end wall 46 of the member being splined by the rotatable clamp in the manner previously described.

The detachable connection of the locator 68 to the housing 78 of the rotatable clamp 66 and the detachable connection of the enlarged head 100 of the unloading member 60 to the shaft 98 thereof facilitate splining of power transmission members having different size openings by merely replacing the locator and the enlarged head with others having the required sizes and shapes. Thus, a power transmission member 30 to be splined with a smaller opening can be mounted on a locator 68 with a smaller annular locating surface 94 and the enlarged head 100 of the unloading member will likewise have a depression 72 with an annular surface 110 of a smaller size.

Hydraulic cylinder 62 has a piston connecting rod 114 whose left end is connected to the associated piston 116 and whose right end extends outwardly through a housing 118 of the cylinder such that a connector 120 connects the piston rod to the shaft 76 of the loading member 58. Hydraulic cylinder 64 has a piston connecting rod 122 whose left end is connected to its piston 124 and whose right end extends outwardly through the right end of its housing 126 for connection to the left end of the unloading member shaft 98. Cylinders 62 and 64 are thus oriented in opposite directions such that the same size piston area is operated on by hydraulic fluid during coordinated movement thereof in the same direction.

For a complete understanding of the manner in which hydraulic fluid is supplied to the cylinders 62 and 64, reference should be made to my copending application Ser. No. 238,285 which is being filed concurrently herewith and assigned to the assignee of the present invention.

While the best mode for carrying out the invention has herein been described in detail, those familiar with the art to which this invention relates will recognize various alternative designs and embodiments for carrying out the invention as defined by the following claims.

What is claimed is:

1. In apparatus for splining an annular thin-wall sleeve of a power transmission member having an end wall including an opening, said apparatus including a toothed mandrel for mounting a member to be splined about a rotational axis, said mandrel having an opening through which the rotational axis extends, and a pair of toothed dies movable in opposite directions with respect to each other on opposite sides of the rotational axis such that the die and mandrel teeth mesh with the sleeve of a mounted power transmission member therebetween to form splines therein, a loader mounted adjacent the mandrel along the rotational axis thereof to provide loading of the power transmission member on the mandrel for splining and subsequent unloading of the splined member from the mandrel, said loader comprising: a loading member movable along the rotational axis toward and away from the mandrel and having a rotatable clamp including a locator that is received within the end wall opening of a power transmission member to be splined, said clamp also including a clamping surface extending about the locator for engaging the end wall of said power transmission member during the loading and unloading as well as clamping the end wall of the power transmission member against the mandrel as the splines are formed in the sleeve thereof, an unloading member that extends through the mandrel opening and is movable along the rotational axis toward and away from the mandrel in coordination with the loading member and including a depression that receives the locator of the loading member during the coordinated movement of the loading and unloading members, and said unloading member including a clamping surface extending about the depression thereof so as to engage the end wall of said power transmission member in an opposed clamping relationship with the clamping surface of the loading member clamp in order to load the power transmission member on the mandrel for splining and subsequently unload the splined member from the mandrel, whereby the unloading member can subsequently be moved away from the loading member and the splined member whose end wall opening receives the locator in preparation for loading another power transmission member to be splined.

2. Apparatus as in claim 1 further including a detachable connection for securing the locator to the rotatable clamp of the loading member.

3. Apparatus as in claims 1 or 2 wherein the unloading member includes: a shaft, an enlarged head defining the depression and the clamping surface of the unloading member, and a detachable connection that secures the enlarged head to the shaft.

4. Apparatus as in claim 3 wherein the locator of the loading member clamp includes a locating surface of an annular shape, the depression of the loading member having a round shape that receives the locator, and the clamping surfaces of the loading member clamp and the unloading member head each having an annular shape.

5. Apparatus as in claim 4 wherein the annular clamping surface on the loading member clamp has an inner diameter larger than the outer diameter of the annular clamping surface on the head of the unloading member.

6. In apparatus for splining an annular thin-wall sleeve of a power transmission member having an annular end wall including a round opening, said apparatus including a toothed mandrel for mounting a member to be splined about a rotational axis, said mandrel having an opening through which the rotational axis extends, and a pair of toothed dies movable in opposite directions with respect to each other on opposite sides of the rotational axis such that the die and mandrel teeth mesh with the sleeve of a mounted member therebetween to form splines therein, a loader mounted adjacent the mandrel along the rotational axis thereof to provide loading of the power transmission member on the mandrel for splining and subsequent unloading of the splined member from the mandrel, said loader comprising: a loading member movable along the rotational axis toward and away from the mandrel and having a rotatable clamp including a round locator that is received within the end wall opening of a power transmission member to be splined, said clamp also including an annular clamping surface extending about the locator for engaging the end wall of said power transmission member during the loading and unloading as well as clamping the end wall of the power transmission member against the mandrel as the splines are formed in the sleeve thereof, an unloading member including a shaft that extends through the mandrel opening for movement along the rotational axis and also including an enlarged head having a round depression for receiving the locator of the loading member, said loading and unloading members being movable in coordination with each other such that the locator of the loading member clamp is received within the depression of the unloading member head during movement thereof along the rotational axis, and said head of the unloading member also including an annular clamping surface extending about the round depression thereof so as to engage the end wall of said power transmission member in an opposed clamping relationship with the annular clamping surface of the loading member clamp in order to load the power transmission member on the mandrel for splining and subsequently unload the splined mandrel from the mandrel, whereby the unloading member can subsequently be moved away from the loading member and the splined member whose end wall opening receives the locator in preparation for loading another power transmission member to be splined.

7. In apparatus for splining an annular thin-wall sleeve of a power transmission member having an annular end wall including a round opening, said apparatus including a toothed mandrel for mounting a member to be splined about a rotational axis, said mandrel having an opening through which the rotational axis extends, and a pair of toothed dies movable in opposite directions with respect to each other on opposite sides of the rotational axis such that the die and mandrel teeth mesh with the sleeve of a mounted member therebetween to form splines therein, a loader mounted adjacent the mandrel along the rotational axis thereof to provide loading of the power transmission member on the mandrel for splining and subsequent unloading of the splined member from the mandrel, said loader comprising: a loading member movable along the rotational axis toward and away from the mandrel and having a rotatable clamp including a housing and a round locator that is received within the end wall opening of a power transmission member to be splined, a detachable connection for securing the locator of the rotatable clamp to the housing thereof, said clamp housing including an annular clamping surface extending about the secured locator for engaging the end wall of said power transmission member during the loading and unloading as well as clamping the end wall of the power transmission member against the mandrel as the splines are formed in the sleeve thereof, an unloading member including a shaft that extends through the mandrel opening for movement along the rotational axis and also including an enlarged head having a round depression for receiving the locator of the loading member, a detachable connection for securing the head of the unloading member to the shaft thereof, hydraulic cylinders for moving the loading and unloading members in coordination with each other such that the locator of the loading member clamp is received within the depression of the unloading member head during movement thereof along the rotational axis, and said head of the unloading member also including an annular clamping surface extending about the round depression thereof so as to engage the end wall of said power transmission member in an opposed clamping relationship with the annular clamping surface of the loading member clamp in order to load the power transmission member on the mandrel for splining and subsequently unload the splined mandrel from the mandrel, whereby the unloading member can subsequently be moved away from the loading member and the splined member whose end wall opening receives the locator in preparation for loading another power transmission member to be splined.

8. In apparatus for splining an annular thin-wall sleeve of a power transmission member having an annular end wall including a round opening, said apparatus including a toothed mandrel for mounting a member to be splined about a rotational axis, said mandrel having an opening through which the rotational axis extends and also having an end including an annular clamping surface, said mandrel opening having an enlarged end adjacent the clamping surface of the mandrel, and a pair of toothed dies movable in opposite directions with respect to each other on opposite sides of the rotational axis such that the die and mandrel teeth mesh with the sleeve of a mounted member therebetween to form splines therein, a loader mounted adjacent the mandrel along the rotational axis thereof to provide loading of the power transmission member on the mandrel for splining and subsequent unloading of the splined member from the mandrel, said loader comprising: a loading member movable along the rotational axis toward and away from the mandrel and having a rotatable clamp including a housing and a round locator that is received within the end wall opening of a power transmission member to be splined, a detachable connection for securing the locator of the rotatable clamp to the housing thereof, said clamp housing including an annular clamping surface extending about the locator so as to engage the end wall of said power transmission member, said annular clamping surface of the clamp having a larger size than the enlarged end of the mandrel opening and being cooperable with the clamping surface of the mandrel to clamp the end wall of a power transmission member during splining thereof, an unloading member including a shaft that extends through the mandrel opening for movement along the rotational axis and also including an enlarged head having a round depression for receiving the locator of the loading member, a detachable connection for securing the head of the unloading member to the shaft thereof, hydraulic cylinders for moving the loading and unloading members in coordination with each other such that the locator of the loading member clamp is received within the depression of the unloading member head during movement thereof along the rotational axis, said hydraulic cylinders moving the enlarged head of the unloading member into the enlarged end of the mandrel opening and moving the clamping surface of the loading member clamp housing into a clamping relationship with the mandrel clamping surface so as to clamp the end wall of a power transmission member during splining thereof, and said head of the unloading member also including an annular clamping surface extending about the round depression thereof so as to engage the end wall of said power transmission member in an opposed clamping relationship with the annular clamping surface on the clamp housing of the loading member in order to load the power transmission member on the mandrel for splining and subsequently unload the splined member from the mandrel, whereby the unloading member can subsequently be moved away from the loading member and the splined member whose end wall opening receives the locator in preparation for loading another power transmission member to be splined.

* * * * *